US009739549B2

(12) United States Patent
Kincel

(10) Patent No.: US 9,739,549 B2
(45) **Date of Patent: *Aug. 22, 2017**

(54) CHARGING HANDLE WITH PUSH ROD

(71) Applicant: Bravo Company USA, Inc., Hartland, WI (US)

(72) Inventor: Eric Stephen Kincel, Las Vegas, NV (US)

(73) Assignee: BRAVO COMPANY MFG, INC., Hartland, WI (US)

( * ) Notice: Subject to any disclaimer, the term of this patent is extended or adjusted under 35 U.S.C. 154(b) by 4 days.

This patent is subject to a terminal disclaimer.

(21) Appl. No.: 14/701,391

(22) Filed: Apr. 30, 2015

(65) Prior Publication Data

US 2016/0320151 A1 Nov. 3, 2016

(51) Int. Cl.
*F41A 3/72* (2006.01)

(52) U.S. Cl.
CPC ..... *F41A 3/72* (2013.01)

(58) Field of Classification Search
CPC ..... F41A 3/72
See application file for complete search history.

(56) References Cited

U.S. PATENT DOCUMENTS

| | | | | |
|---|---|---|---|---|
| 6,311,603 | B1 * | 11/2001 | Dunlap | F41A 3/72 42/2 |
| 7,240,600 | B1 | 7/2007 | Bordson | |
| 7,861,635 | B1 * | 1/2011 | Hoel | F41A 3/20 42/16 |
| 8,104,393 | B2 | 1/2012 | Kincel | |
| 8,336,436 | B2 | 12/2012 | Kincel | |
| 8,356,537 | B2 | 1/2013 | Kincel | |
| 8,960,066 | B2 * | 2/2015 | Gomez | F41A 3/72 42/43 |
| 9,488,424 | B1 * | 11/2016 | Kincel | F41A 3/72 |

* cited by examiner

*Primary Examiner* — Stephen M Johnson
*Assistant Examiner* — Joshua Semick
(74) *Attorney, Agent, or Firm* — Howard & Howard Attorneys PLLC

(57) ABSTRACT

A firearm comprising an upper receiver and a charging handle is disclosed. A charging handle is coupled to the upper receiver and comprises a handle assembly rotationally coupled to a main body about a first and a second pivot point. The handle assembly includes a first handle having an edge nearest the main body and a latch extending from the first handle parallel to the main body for interfacing with the upper receiver in a first position, a second handle having an edge nearest the main body, and a push rod positioned between the edge of the first handle and the edge of the second handle, such that when force is applied to the second handle, energy is transferred through the second handle to the push rod and to the first handle, moving the latch into a second position.

24 Claims, 8 Drawing Sheets

CHARGING HANDLE WITH PUSH ROD

TECHNICAL FIELD

The subject invention generally concerns firearm equipment. More particularly, the present invention relates to a charging handle for a firearm utilizing a push rod.

BACKGROUND OF THE INVENTION

A firearm's charging handle (otherwise known in the art as a "cocking handle" or a "bolt handle") is a device used to cock the hammer, which allows the operator to engage the bolt assembly of a firearm. Charging handles are typically used in rifles and similar firearms, such as the M-16 rifle, the AR-15 rifle, the M-4 carbine, and the Short Barreled Rifle (SBR). Operation of the charging handle facilitates many actions, including, for example, loading a preliminary cartridge, ejecting a spent shell casing or unfired cartridge, clearing an obstruction in the chamber of the rifle, and verifying that the chamber is empty. Typically, a charging handle is T-shaped with a long, slim body and a shorter horizontal crossbar at one end. The charging handle is mounted parallel to the bolt assembly.

The user of a firearm manually operates the charging handle. The user hooks the forefinger of one hand over one end of the crossbar and the middle finger of the same hand over the second end of the crossbar. The user pulls the crossbar rearward, which results in the bolt assembly being moved to the rear. The typical charging handle includes a spring-biased, rotating latch with a hook that engages the firearm receiver when the charging handle is in a forward position. The latch is attached to the charging handle with a pin. When the user pulls the crossbar rearward, the latch disengages from the receiver and allows the charging handle to be pulled rearward.

There are several disadvantages associated with the traditional charging handle design, which requires two fingers to operate. The use of two fingers to operate the charging handle requires that the user move the firearm off target. An improved prior art design includes using paddles on the latch such that the user can press either paddle with one finger or either hand, which releases the latch and moves the charging handle backward. This makes the latch easier to reach and allows the firearm to stay on target. However, this design causes stress on the pin holding the latch to the charging handle.

An improved design includes a lever system that uses one male lever and one female lever that interlock inside the body of the charging handle. An example is described in U.S. Pat. No. 7,240,600, entitled "Rifle Charging Handle with Ambidextrous Latch" issued to Bordson on Jul. 10, 2007, which is incorporated herein by reference. Similarly, an alternate improved design includes an internal lever system with two cam-style, interfacing levers. Examples of such designs are described in U.S. Pat. No. 8,336,436, entitled "Ambidextrous Cam Style Charging Handle" issued to Kincel on Dec. 25, 2012, and U.S. Pat. No. 8,356,537, entitled "Ambidextrous Charging Handle" issued to Kincel on Jan. 22, 2013, which are incorporated herein by reference.

These systems are improvements over prior ambidextrous charging handles because they reduce metal fatigue and torque. However, these systems utilize protruding elements on the crossbar of the charging handle, as well as internal lever systems that are subject to stress and potential breakage after repeat usage. Previous designs that require force to be applied to two surfaces would often result in the user's hand being pinched. Moreover, repeated application of force causes the pivot shaft/roll pin to fail.

The present invention is aimed at one or more of the problems identified above.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

SUMMARY OF THE INVENTION

In one aspect of the present invention, a firearm comprising an upper receiver and a charging handle is disclosed. A charging handle has a handle assembly with two handles and a main body. The first handle includes a latch parallel to the main body. When the latch interfaces with the upper receiver, the charging handle is in a first "locked" position. The handle assembly also includes a push rod positioned between the first handle and the second handle near the main body. When force is applied to the second handle, energy is transferred through the second handle to the push rod and to the first handle, moving the latch away from the upper receiver into a second "unlocked" position.

In another aspect of the present invention, a charging handle with push rod is disclosed. A handle assembly has two handles and a main body. The first handle includes a latch parallel to the main body. When the latch interfaces with the upper receiver, the charging handle is in a first "locked" position. The handle assembly also includes a push rod positioned between the first handle and the second handle near the main body. When force is applied to the second handle, energy is transferred through the second handle to the push rod and to the first handle, moving the latch away from the upper receiver into a second "unlocked" position.

In yet another aspect of the present invention, a firearm comprising an upper receiver and a charging handle is disclosed. A charging handle has a handle assembly with two spring-biased handles and a T-shaped main body. The first handle includes a latch parallel to the main body and a disconnector spring. When the latch interfaces with the upper receiver, the charging handle is in a first "locked"

position, where the charging handle remains stationary on the firearm. The second handle includes a bolt stop spring. There is a plurality of apertures on the first handle and the second handle to prevent collection of debris on the handle assembly. The handle assembly also includes a push rod positioned between the first handle and the second handle near the main body. When force is applied to the second handle, energy is transferred through the second handle to the push rod and to the first handle, moving the latch away from the upper receiver into a second "unlocked" position, in which the charging handle is movable about the firearm.

DETAILED DESCRIPTION OF THE INVENTION

With reference to the drawings and in operation, the present invention overcomes at least some of the disadvantages of known charging handles. The present invention allows the user to apply force with one hand to a single surface (i.e., the lever) rather than two or more surfaces.

Figure 1A:
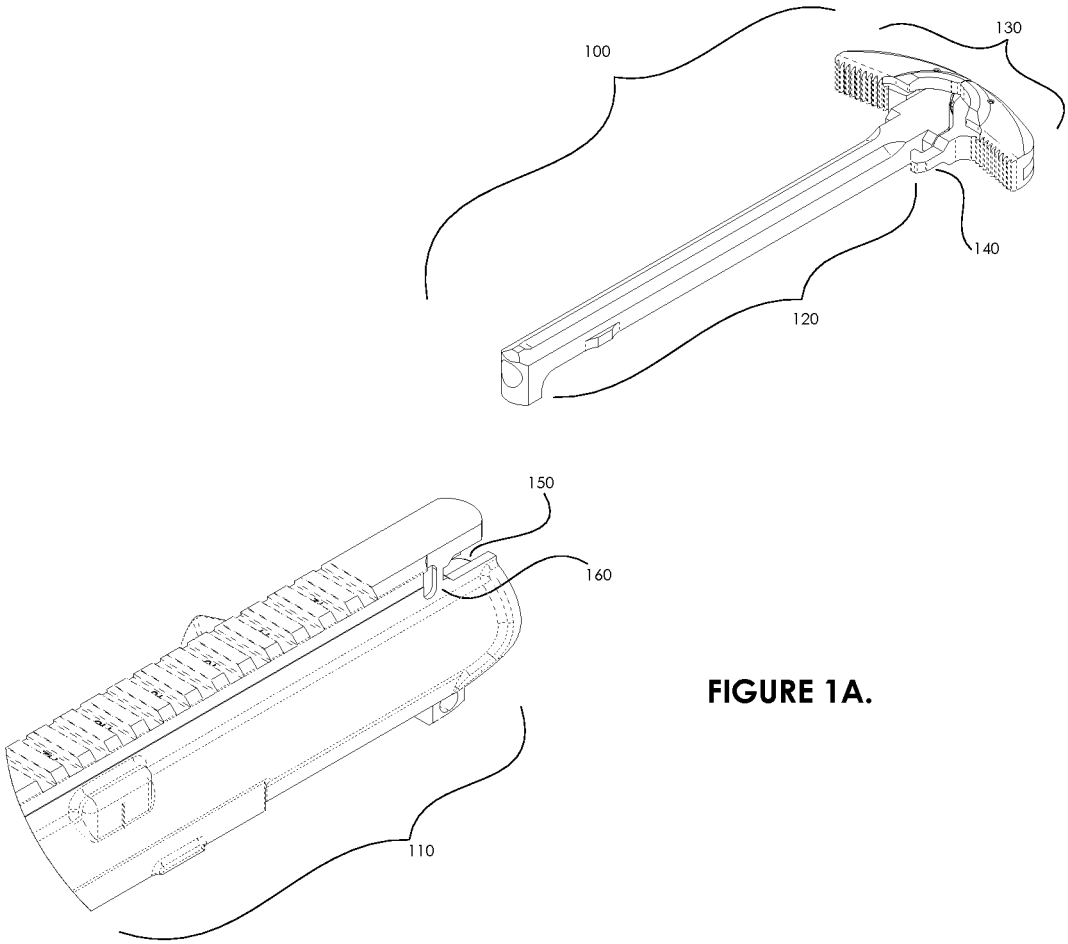
FIG. 1A is an exploded view of a fully assembled charging handle with push rod and an upper receiver of an exemplary firearm.

Referring now to FIG. 1A, an exploded view of a fully assembled charging handle 100 and a cut-away of an upper receiver 110 of an exemplary firearm is shown. Main body 120 is T-shaped and coupled to handle assembly 130. Handle assembly 130 includes a latch 140. When coupled to the upper receiver 110, main body 120 of charging handle 100 slides into an opening 150. Latch 140 interfaces with upper receiver 110 at a latch aperture 160. When latch 140 is engaged in latch aperture 160, the charging handle 100 is in the "locked" position and remains stationary.

Figure 1B:
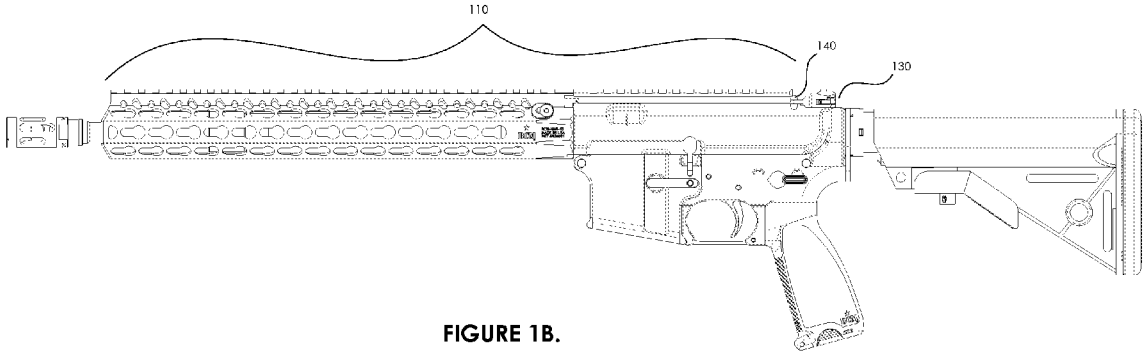
FIG. 1B is a side view of a fully assembled charging handle with push rod on an exemplary firearm.
Figure 1C:
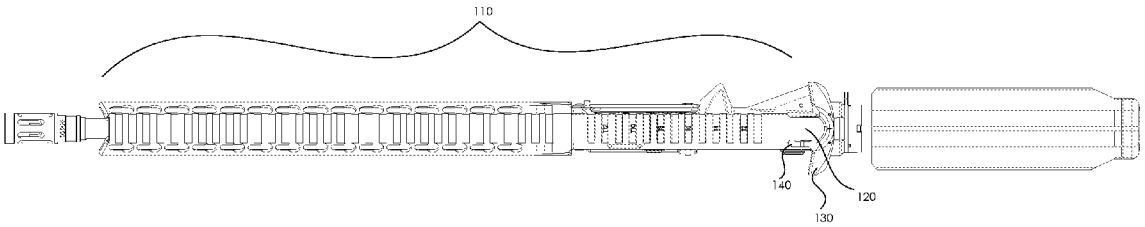
FIG. 1C is a top view of a fully assembled charging handle with push rod on an exemplary firearm.

Referring now to FIGS. 1B and 1C, views of a fully assembled charging handle with push rod on an exemplary firearm are shown, wherein the charging handle assembly is shown in a locked position. Charging handle 100 is positioned partially within upper receiver 110 with the portion of charging handle 100 containing handle assembly 130 exposed for operator manipulation.

Figure 2A:
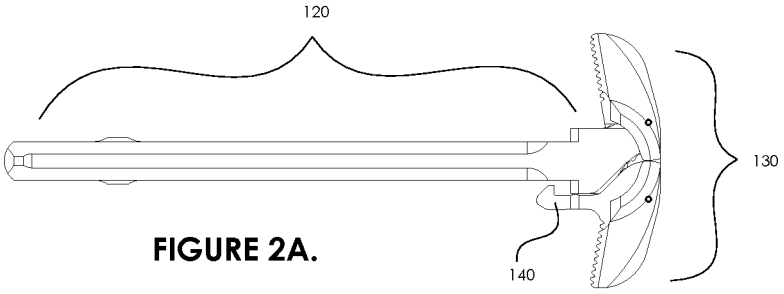
FIG. 2A is a top plan view of a charging handle with push rod.
Figure 2B:
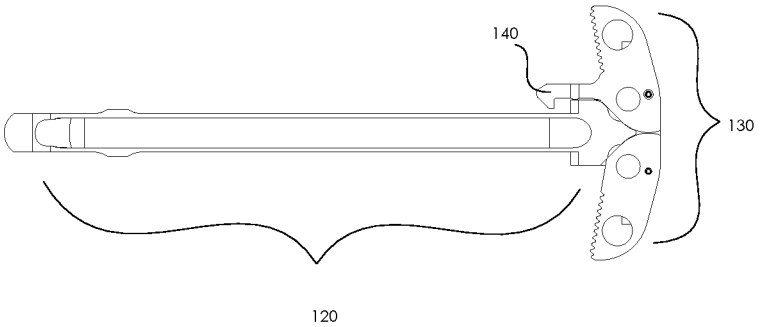
FIG. 2B is a bottom plan view of a charging handle with push rod.

Referring now to FIGS. 2A-2B, top plan and bottom plan views of a fully assembled charging rod (independent of the firearm) are shown.

Figure 3:
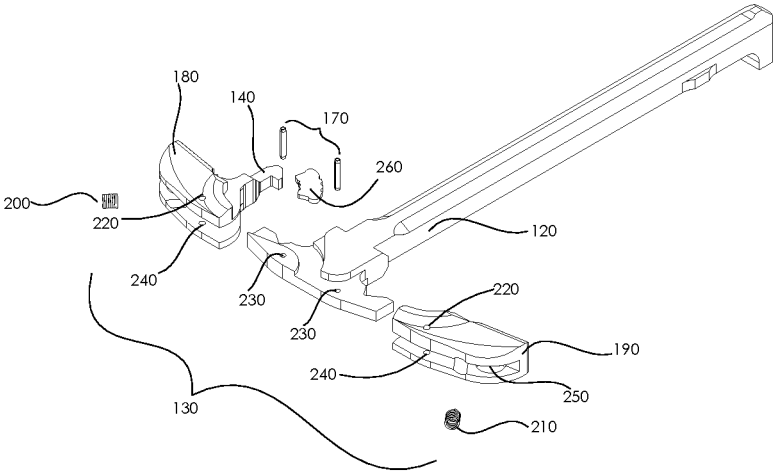
FIG. 3 is an exploded perspective view of a charging handle with push rod.

Referring now to FIG. 3, an exploded view of a charging handle with push rod is illustrated, respectively. Main body 120 is T-shaped and coupled to handle assembly 130 with pins 170. Handle assembly 130 consists of a first handle 180 and a second handle 190. First handle 180 and second handle 190 each comprise two connected plates (upper and lower) with a cavity in the center. First handle 180 includes latch 140 and may be spring-biased to include disconnector spring 200. Disconnector spring 200 may be an AR15/M16/M4 disconnector spring as is commonly known in the art, which is used to reset the disconnector in the firearm's fire control/trigger group. First handle 180 includes an external edge furthest away from main body 120 and an internal edge closest to main body 120.

Second handle 190 may be spring-biased to include bolt stop spring 210, an external edge furthest away from main body 120, and an internal edge closest to main body 120. Bolt stop spring 210 may have less tension than disconnector spring 200. Bolt stop spring 210 may be what is commonly known in the art as a "bolt catch" spring, as it is used to apply force to the bolt catch, keeping it in the unlocked position.

Disconnector spring 200 and bolt stop spring 210 may be interchangeable with a "parts" rifle, such that the user can use the parts from a "parts" rifle to keep the handle functioning. Similarly, the user may use the springs in the charging handle to keep the rifle operational should the need arise, e.g., in an emergency situation on the battlefield.

As can be seen from FIG. 3, pins 170 pass through apertures 220 in the first plates of first handle 180 and second handle 190, apertures 230 in main body 120, and apertures 240 in the second plates of first handle 180 and second handle 190, to secure the handle assembly 130 to main body 120.

Referring again to FIG. 3, first handle 180 and second handle 190 may contain a number of circular apertures, one of which is labeled 250, in the second plate, which serve a dual purpose of making the charging handle lighter by removing mass from the assembly, and of allowing dirt or debris to pass through instead of collecting in the handle assembly. A push rod 260 is also illustrated, which is described in more detail below.

Figure 4:
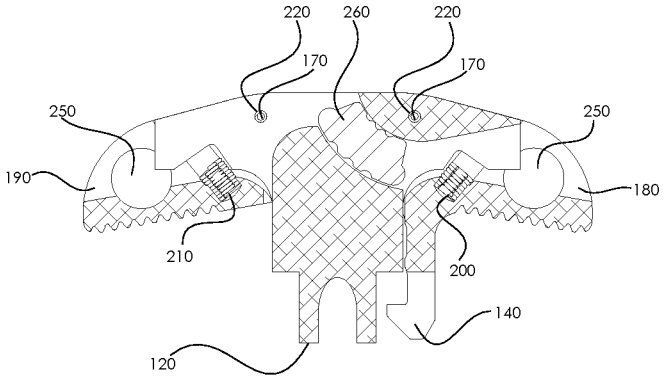
FIG. 4 is a top plan view of a partial charging handle with push rod.

Referring now to FIG. 4, a top plan view of a partial charging handle with push rod is illustrated. Push rod 260 is shown interfacing on a first side with the internal edge of first handle 180, and on a second side the internal edge of second handle 190.

Thus, the traditional lever system in the charging handle has been replaced in the present invention by a handle and push rod system that eliminates the necessity of interlocking or interfacing latches.

Figure 5A:
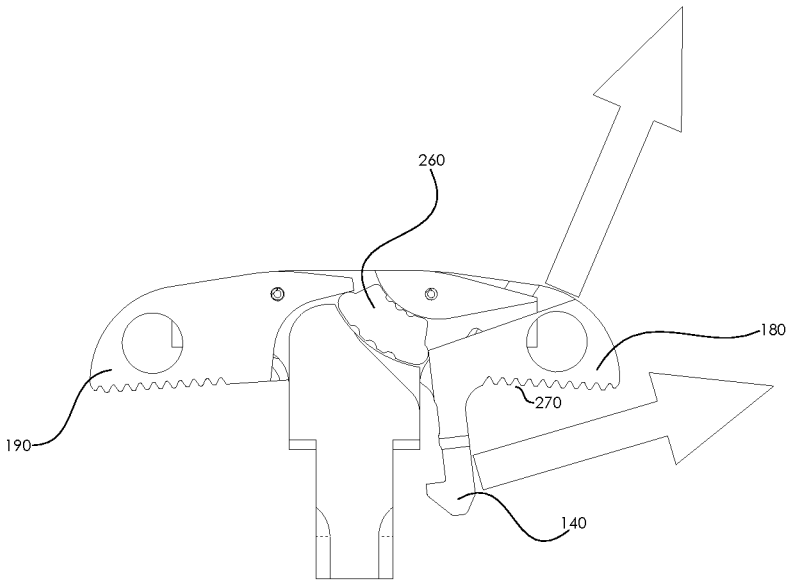
FIGS. 5A and 5B are cross-sectional views of a partial charging handle with push rod illustrating operation of the charging handle assembly.
Figure 5B:
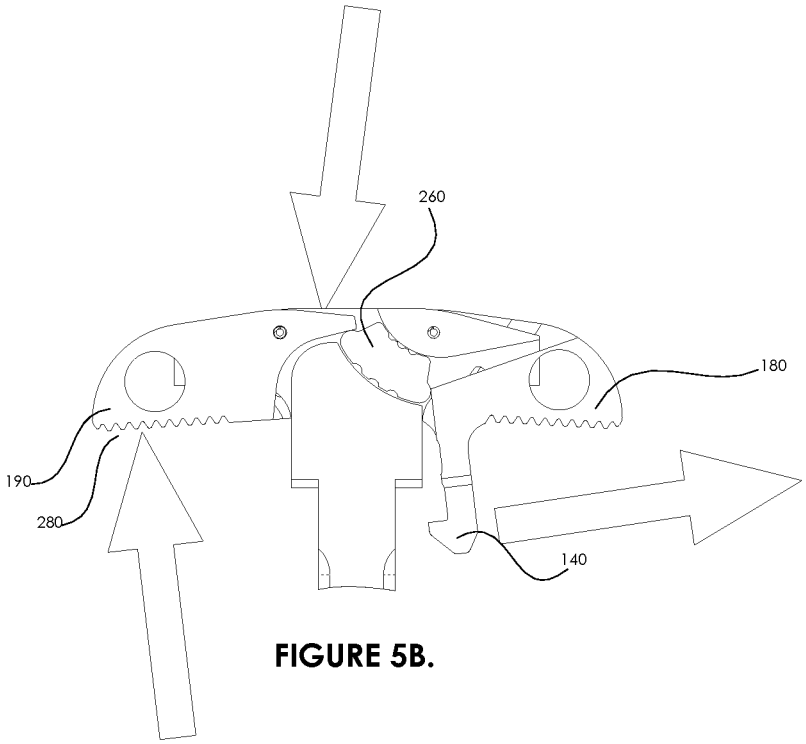

Referring now to FIGS. 5A and 5B, cross-sectional views of a partial charging handle with push rod illustrating operation of the charging handle assembly are shown. As seen in FIG. 5A, pressure may be applied by the user (with one finger, for example) in a rearward direction to finger surface 270. This motion causes an internal edge of second handle 190 to create pressure on push rod 260 in a forward direction. Push rod 260 transfers the force to an internal edge of first handle 180, which in turn moves latch 140 in an outward direction, which ultimately disengages the latch from the firearm receiver into an "unlocked" position.

Similarly, as shown in FIG. 5B, pressure may be applied by the user (with one finger, for example) in a rearward direction to finger surface 280. This motion causes the movement of latch 140 in an outward direction, which disengages the latch from the firearm receiver into an "unlocked" position.

FIGS. 5A and 5B illustrate that a user may use a single finger to disengage latch 140 by applying pressure either to first handle 180 or to second handle 190. Alternatively, the user may use more than one finger to disengage latch 140 by applying pressure to both first handle 180 and second handle 190 simultaneously. No pressure is applied either directly or by transfer to main body 120.

Obviously, many modifications and variations of the present invention are possible in light of the above teachings. In addition, the reference numerals in the claims are merely for convenience and are not to be read in any way as limiting.

What is claimed is:

1. A firearm comprising:

an upper receiver; and a charging handle coupled to the upper receiver, the charging handle comprising:

a T-shaped main body, wherein a top end of the main body includes a first arm and a second arm, a handle assembly having a first handle and a second handle, wherein the first handle and the second handle cover the first arm and the second arm of the main body, the first handle being rotationally coupled around the first arm of the main body about a first pivot point and having a first edge nearest the main body, a second edge farthest from the main body, and a latch extending from the first handle parallel to the main body for interfacing with the upper receiver in a first position, the second handle being rotationally coupled around the second arm of the main body about a second pivot point and having a first edge nearest the main body and a second edge farthest from the main body, and a push rod positioned between the first edge of the first handle and the first edge of the second handle, such that when force is applied to the second handle, energy is transferred through the second handle to the push rod and then to the first handle, wherein the latch is moved into a second position.

2. The firearm of claim 1, wherein the first handle is spring-biased.

3. The firearm of claim 2, wherein the first handle is biased by a disconnector spring.

4. The firearm of claim 1, wherein the second handle is spring-biased.

5. The firearm of claim 4, wherein the second handle is biased by a bolt stop spring.

6. The firearm of claim 1, wherein the first position is a locked position wherein the charging handle remains stationary on the firearm.

7. The firearm of claim 1, wherein the second position is an unlocked position where the charging handle is movable about the firearm.

8. The firearm of claim 1, wherein the handle assembly includes a plurality of apertures to prevent debris from collecting on the handle assembly.

9. The firearm of claim 1, wherein the main body is coupled to the handle assembly by one or more pins.

10. A charging handle for a firearm, the charging handle comprising:

a T-shaped main body, wherein a top end of the main body includes a first arm and a second arm; and a handle assembly rotationally coupled to the main body about a first pivot point and a second pivot point, wherein the handle assembly comprises:

a first handle and a second handle, wherein the first handle and the second handle cover the first arm and the second arm of the main body, the first handle being rotationally coupled around the first arm of the main body about the first pivot point and having a first edge nearest the main body, a second edge farthest from the main body, and a latch extending from the first handle parallel to the main body for interfacing with the upper receiver in a first position, the second handle being rotationally coupled around the second arm of the main body about the second pivot point and having a first edge nearest the main body and a second edge farthest from the main body, and a push rod positioned between the first edge of the first handle and the first edge of the second handle, such that when force is applied to the second handle, energy is transferred through the second handle to the push rod and then to the first handle, wherein the latch is moved into a second position.

11. The charging handle of claim 10, wherein the first handle is spring-biased.

12. The charging handle of claim 11, wherein the first handle is biased by a disconnector spring.

13. The charging handle of claim 10, wherein the second handle is spring-biased.

14. The charging handle of claim 13, wherein the second handle is biased by a bolt stop spring.

15. The charging handle of claim 10, wherein the first position is a locked position wherein the charging handle remains stationary on the firearm.

16. The charging handle of claim 10, wherein the second position is an unlocked position where the charging handle is movable about the firearm.

17. The charging handle of claim 10, wherein the handle assembly includes a plurality of apertures to prevent debris from collecting on the handle assembly.

18. The charging handle of claim 10, wherein the main body is coupled to the handle assembly by one or more pins.

19. A firearm comprising:

an upper receiver; and a charging handle coupled to the upper receiver, the charging handle comprising:

a T-shaped main body, wherein a top end of the main body includes a first arm and a second arm, a handle assembly having a spring-biased first handle and a spring-biased second handle, the handle assembly being rotationally coupled to the main body by one or more pins, wherein the first handle and the second handle cover the first arm and the second arm of the main body, the first handle being rotationally coupled around the first arm of the main body about a first pivot point and biased by a disconnector spring, a first edge nearest the main body, a second edge farthest from the main body, and a latch extending from the first handle parallel to the main body for interfacing with the upper receiver in a first position, wherein the first position is a locked position wherein the charging handle remains stationary on the firearm, the second handle being rotationally coupled around the second arm of the main body about a second pivot point and biased by a bolt stop spring, a first edge nearest the main body and a second edge farthest from the main body, and the first handle and the second handle including a plurality of apertures to prevent debris from collecting on the handle assembly, and a push rod positioned between the first edge of the first handle and the first edge of the second handle, such that when force is applied to the second handle, energy is transferred through the second handle to the push rod and then to the first handle, wherein the latch is moved into a second position, wherein the second position is an unlocked position where the charging handle is movable about the firearm, and wherein the first handle is operational independent of the second handle, such that when force is applied to the first handle, the latch is moved to the second position.

20. The firearm of claim 1, wherein the first handle is operational independent of the second handle, such that when force is applied to the first handle, the latch is moved to the second position.

21. The charging handle of claim 10, wherein the first handle is operational independent of the second handle, such that when force is applied to the first handle, the latch is moved to the second position.

22. A firearm comprising:

an upper receiver; and a charging handle coupled to the upper receiver, the charging handle comprising:

a T-shaped main body, wherein a top end of the main body includes a first arm and a second arm, and a handle assembly having a first handle and a second handle, wherein the first handle and the second handle cover the first arm and the second arm of the main body, the first handle being rotationally coupled around the first arm of the main body about a first pivot point and having a first edge nearest the main body, a second edge farthest from the main body, and a latch extending from the first handle parallel to the main body for interfacing with the upper receiver in a first position, the second handle being rotationally coupled around the second arm of the main body about a second pivot point and having a first edge nearest the main body and a second edge farthest from the main body, and wherein the first handle is operational independent of the second handle, such that when force is applied to the first handle, the latch is moved to the second position.

23. The firearm of claim 3, wherein the disconnector spring is an AR15/M16/M4 disconnector spring.

24. The charging handle of claim 12, wherein the disconnector spring is an AR15/M16/M4 disconnector spring.

* * * * *